United States Patent [19]

Bolton et al.

[11] Patent Number: 4,763,964

[45] Date of Patent: Aug. 16, 1988

[54] SLIDING DOOR ASSEMBLY

[75] Inventors: Theodore S. Bolton; James E. Napolitano, both of Liverpool, N.Y.

[73] Assignee: Carrier Corporation, Syracuse, N.Y.

[21] Appl. No.: 882,555

[22] Filed: Jul. 7, 1986

[51] Int. Cl.[4] ..... E05D 15/20

[52] U.S. Cl. ..... 312/100; 312/138 R; 49/127

[58] Field of Search ..... 312/100, 138 R, 304, 312/297; 49/127, 128, 130

[56] References Cited

U.S. PATENT DOCUMENTS

| | | | |
|---|---|---|---|
| 570,711 | 11/1896 | Newhall | 49/127 |
| 1,876,365 | 9/1932 | Taylor | 49/128 |
| 2,416,132 | 2/1947 | Watson | 49/130 |
| 2,930,332 | 3/1960 | Cook et al. | 49/127 |
| 2,992,460 | 7/1961 | Hentges | 49/130 |
| 3,025,937 | 3/1962 | Fenkel | 189/46 |
| 3,334,375 | 8/1967 | Hubbard | 49/127 |
| 3,748,005 | 7/1973 | Montvale | 312/109 |
| 4,097,009 | 6/1978 | Barnes | 244/129 |
| 4,292,815 | 10/1981 | Bolton | 62/262 |
| 4,333,206 | 6/1982 | Lang | 16/335 |
| 4,478,267 | 10/1984 | Smiley | 160/97 |
| 4,600,254 | 7/1986 | Whalen | 312/138 R |

FOREIGN PATENT DOCUMENTS

| | | | |
|---|---|---|---|
| 2028264 | 6/1972 | Fed. Rep. of Germany | 49/127 |
| 87079 | 8/1936 | Sweden | 49/130 |
| 451471 | 8/1936 | United Kingdom | 49/128 |
| 513990 | 10/1939 | United Kingdom | 49/128 |

*Primary Examiner*—Victor N. Sakran

*Attorney, Agent, or Firm*—Dana F. Bigelow

[57] ABSTRACT

A control panel door is mounted to the front grille panel of an air conditioning system in such a way as to allow it to be opened by first pivoting it to an oblique position and then sliding it to a position behind the front grille panel. Provision is made for easily assembling the door to its supporting track structure while at the same time preventing its accidental disassembly when opening the door. Provision is also made for holding the door in the closed position.

12 Claims, 2 Drawing Sheets

SLIDING DOOR ASSEMBLY

BACKGROUND OF THE INVENTION

This invention relates generally to door mounting assemblies and, more particularly, to doors for control panels of air conditioning systems.

Room air conditioners are generally self-contained with the controls for adjusting the various operating parameters being located on the front side thereof for easy access by the operator. However, inasmuch as a room air conditioner is generally located in a rather prominent location within a room, the manufacturers have strived to make them aesthetically pleasing. In this regard, it has generally been the practice to make the front face as unobtrusive as possible by blending it in with the surrounding area such as, for example, by providing a natural wood-like appearance to the front grille structure. As part of this effort, it has also become customary to provide a door over the control panel. Such a door not only enhances the appearance of the front panel, but also protects the control panel from such things as use by children and exposure to dust and the like.

The most common way of mounting such a door is that of using hinges at one side thereof with the door opening outwardly. One great disadvantage to such a door is that it is easily damaged since, when it is in the open position, it is very susceptible to being broken or otherwise damaged. In addition, hinged doors are relatively expensive to manufacture and install on air conditioning equipment.

It is therefore an object of the present invention to provide an improved door and mounting apparatus for a control panel of an air conditioning system.

Another object of the present invention is to provide a control panel door which is not particularly susceptible to breakage.

Yet another object of the present invention is the provision for a control panel door which is simple to install and to operate.

Still another object of the present invention is the provision for a control panel door which is economical to manufacture and extremely functional in use.

These objects and advantages become more readily apparent upon reference to the following description when taken in conjunction with the appended drawings.

SUMMARY OF THE INVENTION

Briefly, in accordance with one aspect of the invention, there is provided a track mounted door which can be opened by pivoting one end inwardly and then sliding the door along the track at an angle with the front face of the grille, such that when the door is open, it is disposed behind the front face of the grille and thereby protected from breakage.

By another aspect of the invention, the door is mounted on upper and lower tracks which extend transversely across the control panel at a rearward angle from the front face of the grille. Upper and lower slots on the door slideably receive the respective upper and lower rails such that the door can be slid along the rails to its open position behind the front grille structure. The door slots also include portions which extend substantially rearwardly from the face of the door to allow one end of the door to also pivot on the track. Thus, an opening of the door involves first the pivoting of one end of the door rearwardly, and then a sliding of the door in an oblique direction to a position behind the grille front face.

By still another aspect of the invention, mating elements are provided both on the one end of the door and on both ends of the track such that the door is properly mated to the track in both the closed and in the open positions. This is accomplished by providing a latch ear and a stop ear on the respective ends of each track and also providing a notch in one end of the door slot, with the notch being engageable with the latch ear when the door is in the closed position and engaged with the stop ear when the door is in the fully opened position.

In the drawings as hereinafter described, a preferred embodiment is depicted. However, various other modifications and alternate constructions can be made thereto without departing from the true spirit and scope of the invention.

DESCRIPTION OF THE PREFERRED EMBODIMENT

Figure 1:
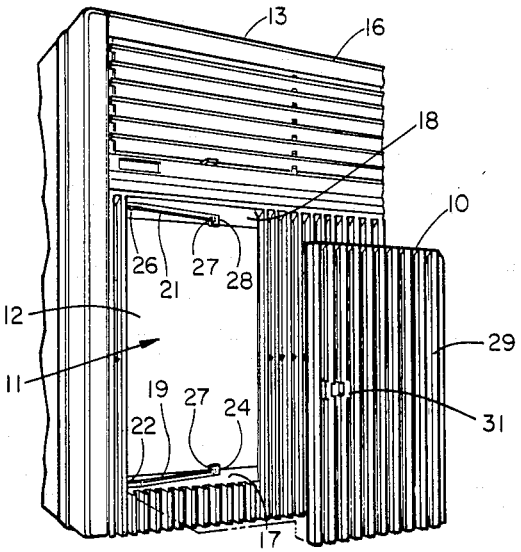
FIG. 1 is an exploded perspective view of a room air conditioner with a control panel door in accordance with the present invention.

Referring to FIG. 1, the door of the present invention is shown at 10 as applied to an opening 11 for a control panel 12 of a room air conditioner 13 installed in a wall 14 of a space to be cooled. The air conditioner 13 includes a front grille structure 16 that is attached to and covers the front surface of the air conditioner chassis. The door 10, which forms a part of the front grille 16 and is therefore preferably designed such that its outer surface is the same as or compatible with that of the surrounding structure, is slideably attached to the front grille structure in a manner which allows the achievement of the above objectives.

As will be seen in FIG. 1, the grille structure 16 includes lower and upper rearwardly extending shelves 17 and 18 which act to support the door 10. Attached to the lower and upper shelves 17 and 18 are lower and upper tracts 19 and 21 extending substantially normally from their respective shelves. Forming an integral part of the lower track 19 is a generally rearwardly extending latch ear 22 at the one end thereof and both a rearwardly extending stop ear 23 and a upwardly extending guide ear 24 at the other end thereof. These can be more clearly seen by reference to FIG. 3. Similarly, forming a part of the upper track 21 is a generally rearwardly extending latch ear 26, a rearwardly extending stop ear 27 and a downwardly extending guide ear 28. These track structures are preferably formed as an integral part of the front grille structure 16 such as by injection molding or the like.

Figure 2:
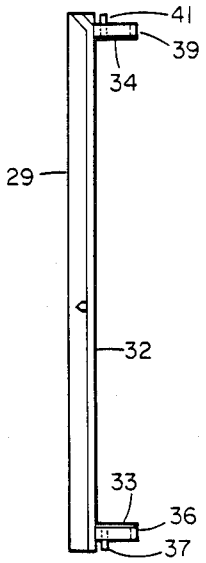
FIG. 2 is a side view of the door portion thereof.
Figure 3:
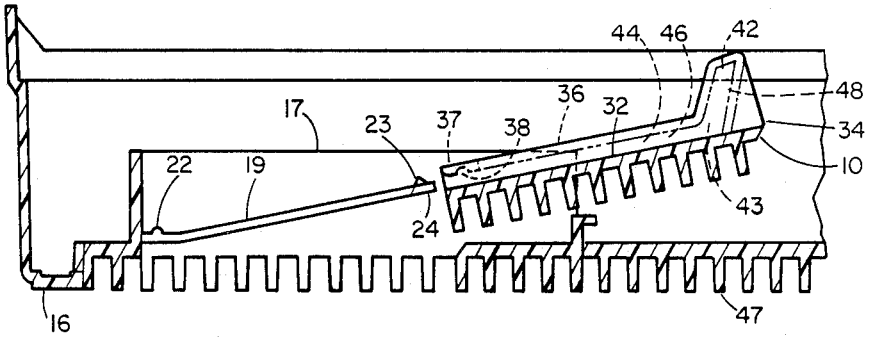
FIG. 3 is a top sectional view of the door being installed in a grille frame.

Referring now to FIGS. 1–3, the door 10 is shown to include a decorative front portion 29 having an indent 31 for use as a handle in opening and closing the door. Integrally attached to and extending rearwardly from the door body 32 are the lower and upper flanges 33 and 34. The lower flange 33 includes an integrally attached, downwardly extending guide rib 36 that extends along the width of the door 32 and which has attached at one end a tab 37 which extends further downwardly as shown in FIG. 2 and which has formed therein a latch groove 38 as shown in FIG. 3. Similarly, the upper flange 34 has an associated upwardly extending guide rib 39 with an integrally attached tab 41. As will be seen in FIG. 2, the tab 37 does not extend downwardly quite as far as the lower edge of the door body 32, and the upper tab 41 does not extend upwardly quite as far as the upper edge of the door body 32. This feature allows for a more free sliding movement of the door within the confines of the upper and lower shelves 17 and 18, respectively.

As will be seen in FIG. 3, the lower guide rib 36 comprising a three-sided angled portion 42 defining an angled slot 43, and a linear portion 44 which, together with the rear side of the door body 32 defines a linear slot 46. The upper grille rib 39 is of the same shape and operates in substantially the same manner as does the lower guide rib 36.

Figure 4:
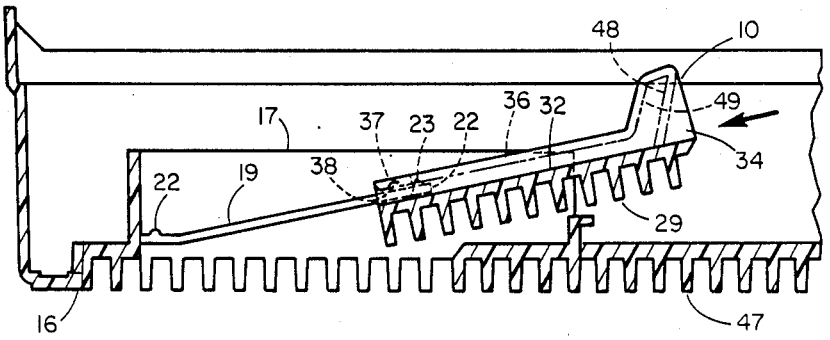
FIGS. 4–6 show the installed door in various positions between the open and closed positions.
Figure 5:
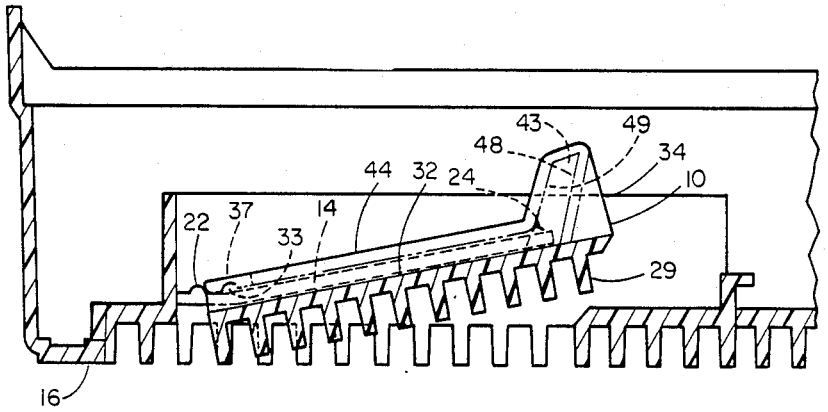

Referring now to FIGS. 3–5, the installation and operation of the door 10 in relation to the front grille and associated lower track 19 will now be described, it being understood that the upper part of the door structure and front grille structure, including the upper grille rib 39 and associated track 21, are substantially the same both in structure and in function.

In FIG. 3, the door 10 is placed into position for assembly, behind the front face 47 of the front grille structure 16. It will be seen that the linear slot 46 is placed in general alignment with the lower track 19, and of course it will be understood that the upper grille rib 39 is similarly aligned with the upper track 21. To assemble the door 10 onto the front grille frame 16, the door is slid along the end of the track 19 such that the guide ear 24 tracks along the linear slot 46. When the guide rib tab 37 reaches the track stop ear 23, it is caused to deflect slightly rearwardly to allow the rear edge of the stop ear 23 to pass over the beveled leading edge of the tab 37, through the latch groove 38 and over the rear edge of the tab 37. As shown in FIG. 4, the door 10 is then in its installed but open position, with the lower edge of its body 32 being supported by the lower shelf 17 of the front grille 16.

Figure 6:
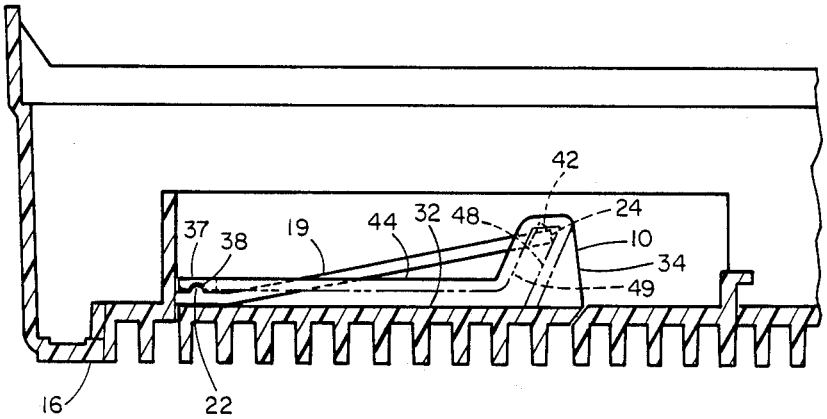

To close the door, the door is slid farther to the left with the track guide ear 24 traveling along the linear slot 46 and the guide rib tab 37 traveling along the rear side of the lower track 19. When the beveled edge of the guide rib tab 37 reaches the track latch ear 22, as shown in FIG. 5, the track guide ear 24 has passed through the linear slot 46 and is now entering the angled slot 43. As the door is now pushed further to the left, the guide rib angled surface 48 engages the right edge of the guide ear 24 causing the door to pivot in a clockwise direction while the guide ear 24 travels along the angled surface 48 into the angled slot 43. At the same time, the tab 37 of the guide rib 36 is caused to flex away from the back surface of the door as it slides over the latch ear 22. When the latch groove 38 snaps over the latch ear 22, then the door is in the fully closed position as shown in FIG. 6. At this point the guide ear 24 is at the end of the angled slot 43 as shown.

To open the door, it is pushed to the right with the angled surface 49 sliding along the left edge of the guide ear 24, causing the door to rotate in a counterclockwise direction and the latch groove 38 to be forced off the latch ear 22. The door rotates until the guide ear 24 has passed through the angled slot 43 and has contacted the rear side of the door body 32. Further movement of the door to the right will now be in a linear direction with the guide ear 24 traveling along the linear slot 46. When the right edge of the tab 37 engages the left edge of the stop ear 23 as shown in FIG. 4, the door can be pushed no further and is in the fully open position.

Although the invention has been described in terms of a particular structure, it should be understood that other forms may be used while remaining within the scope of the present invention.

What is claimed is:

1. In an air conditioning apparatus of the type having a front grille structure with a control panel opening and an access door for convering the control panel, an improved control panel door and mounting assembly comprising:

a guide track attached to the grille structure at one edge of the control panel opening, said guide track having a track portion extending generally transversely across the control panel opening but at an angle of increasing distance therefrom, and a guide portion extending substantially normally from said track portion; and a door for placement within the control panel opening, said door having a slot structure formed in the rear side thereof for mounting said door to said guide track, said slot structure having a slide portion extending transversely across and in substantially parallel relationship with said door, and a pivot portion extending further in the generally transverse direction but at an angle of increasing distance from said door, said slot being positioned and sized so as to allow said track guide portion to slideably transverse said slot pivot and slide portions as said door moves between the fully closed and fully opened positions.

2. A control panel door and mounting assembly as set forth in claim 1 wherein said grille structure includes a rearwardly extending shelf at one edge of the control panel opening and further wherein said guide track is integrally formed on said shelf.

3. A control panel door and mounting assembly as set forth in claim 2 wherein said shelf is disposed at the lower edge of said control panel opening and further wherein said shelf acts as a support for the door with the lower edge of the door resting on the upper surface of the shelf.

4. A control panel door and mounting assembly as set forth in claim 1 and including a second guide track attached to the grille structure and a second slot structure attached to said door, said second guide track and slot structure being disposed on the opposite side of said control panel opening from said first guide track and slot structure.

5. A control panel door and mounting assembly as set forth in claim 1 wherein said guide track includes a stop ear at one end of said track portion and said slot slide portion has a tab portion, said stop ear being engageable by said tab portion when said door is in the fully open position to prevent said door from being removed from said track.

6. A control panel door and mounting assembly as set forth in claim 5 wherein said stop ear has a beveled surface on one side thereof such that said slot tab portion can slide thereover to facilitate the initial assembly of said door to said track.

7. A control panel door and mounting assembly as set forth in claim 1 wherein said slot pivot portion is partially defined by a first obliquely aligned surface which interacts with said track guide portion to pivot said door from an oblique position generally aligned with said track to a transverse position generally aligned with the control panel opening when the door is moved to the fully closed position.

8. A control panel door and mounting assembly as set forth in claim 1 wherein said slot pivot portion is partially defined by a second obliquely aligned surface which interacts with said track guide portion to pivot said door from a transverse position generally aligned with the control panel opening to an oblique position generally aligned with the said track when the door is initially opened from the fully closed position.

9. An improved door mounting apparatus for use with an air conditioning system having a grille structure with a front face and an associated control panel opening, comprising:

track means attached to the front grille structure and extending across one edge of the control panel opening at an oblique angle therewith;

a door for covering the control panel opening when placed in a closed position coincident with the grille structure front face and exposing the control panel opening when placed in an open position behind the grille structure front face; and slot means attached to said door for slideably engaging said track means, said slot means having a pivot portion extending at an oblique angle from the rear side and near one end of said door such that said one end can be pushed backwardly from said closed position to place the door at an oblique angle with said grille structure front face, and a slide portion extending substantially parallel with said door with said slide portion being adapted to slideably receive said track means therein such that said door may be subsequently slid along said track to said open position.

10. In a room air conditioner of the type having a grille structure and a control panel, a door for covering the control panel comprising:

track means attached to the grille structure said track means having a portion thereof which is disposed at an oblique angle with the front face of the grille structure; and slot means attached to the door, said slot means having a pair of opposed engagement surfaces for slideably retaining said track means therebetween such that the door can be slideably moved along said track means between an open position wherein it is disposed generally behind said front face of the grille and a closed position wherein it is substantially disposed in the plane of said front face of the grille.

11. A door as set forth in claim 10 wherein said door is disposed in a vertical orientation when in both the open and closed positions, and further wherein said track means is disposed adjacent a lower edge thereof.

12. A door as set forth in claim 11 and including a second track means and a second slot means disposed adjacent an upper edge of the door.

* * * * *